US008414229B2

(12) United States Patent
Can et al.

(10) Patent No.: US 8,414,229 B2
(45) Date of Patent: Apr. 9, 2013

(54) CBN COMPOSITE MATERIAL AND TOOL

(75) Inventors: Nedret Can, Boksburg (ZA); Guven Akdogan, Johannesburg (ZA); Peter Michael Harden, Limerick (IE); Cornelius Johannes Pretorius, Sixmilebridge (IE)

(73) Assignee: Element Six Abrasives S.A., Luxembourg (LU)

( * ) Notice: Subject to any disclaimer, the term of this patent is extended or adjusted under 35 U.S.C. 154(b) by 0 days.

(21) Appl. No.: 12/295,762

(22) PCT Filed: Apr. 23, 2007

(86) PCT No.: PCT/IB2007/001046

§ 371 (c)(1),
(2), (4) Date: Oct. 7, 2009

(87) PCT Pub. No.: WO2007/122490

PCT Pub. Date: Nov. 1, 2007

(65) Prior Publication Data

US 2010/0018127 A1 Jan. 28, 2010

(30) Foreign Application Priority Data

Apr. 21, 2006 (ZA) ..... 2006/03211

(51) Int. Cl.

| | |
|---|---|
| ***B23P 12/28*** | (2006.01) |
| ***B23P 1/00*** | (2006.01) |
| ***B23P 3/00*** | (2006.01) |
| ***B24D 3/02*** | (2006.01) |
| ***C09C 1/68*** | (2006.01) |
| *C22C 29/02* | (2006.01) |

(52) U.S. Cl. ..... 407/118; 51/307; 75/236; 428/698

(58) Field of Classification Search ..... 51/307; 407/118; 428/551; 75/239
See application file for complete search history.

(56) References Cited

U.S. PATENT DOCUMENTS

| | | | | |
|---|---|---|---|---|
| 5,395,700 | A * | 3/1995 | Nakai et al. | 428/552 |
| 5,712,030 | A * | 1/1998 | Goto et al. | 428/332 |
| 6,599,062 | B1 * | 7/2003 | Oles et al. | 407/119 |
| 6,652,201 | B2 * | 11/2003 | Kunimori et al. | 407/35 |

(Continued)

FOREIGN PATENT DOCUMENTS

| | | | |
|---|---|---|---|
| EP | 0 520 403 | A | 12/1992 |
| JP | 5-004101 | A | 1/1993 |

(Continued)

OTHER PUBLICATIONS

Official action issued by Japanese Patent Office for corresponding Japanese application 2009-505993, mailing date May 15,2012, includes English translation of action.

*Primary Examiner* — Pegah Parvini
(74) *Attorney, Agent, or Firm* — Frommer Lawrence & Haug LLP; Ronald R Santucci

(57) ABSTRACT

The invention provides a tool component comprising a first layer of polycrystalline cBN material which has a rake (working) surface and a flank surface and comprises less than 70 vol % cBN; and a secondary layer across the rake surface or at least partially across the rake surface and comprising a refractory material and optionally a binder phase and optionally cBN, wherein the secondary layer has a higher resistance to crater formation than the first layer of cBN material and has a lower affinity towards iron than cBN.

28 Claims, 1 Drawing Sheet

U.S. PATENT DOCUMENTS

| | | | | |
|---|---|---|---|---|
| 7,410,707 | B2 * | 8/2008 | Fukui et al. | 428/698 |
| 2001/0003569 | A1 * | 6/2001 | Ota et al. | 407/118 |
| 2001/0054332 | A1 | 12/2001 | Cheynet De Beaupre et al. | |

FOREIGN PATENT DOCUMENTS

| | | | |
|---|---|---|---|
| JP | 07 024606 | A | 1/1995 |
| JP | 08-323506 | A | 12/1996 |
| JP | 10-180508 | A | 7/1998 |
| JP | 10-245287 | A | 9/1998 |
| JP | 2004-332006 | A | 11/2004 |
| WO | WO 2004/040095 | A | 5/2004 |
| WO | WO 2005/053887 | * | 6/2005 |
| WO | WO 2006/023845 | A | 3/2006 |

* cited by examiner

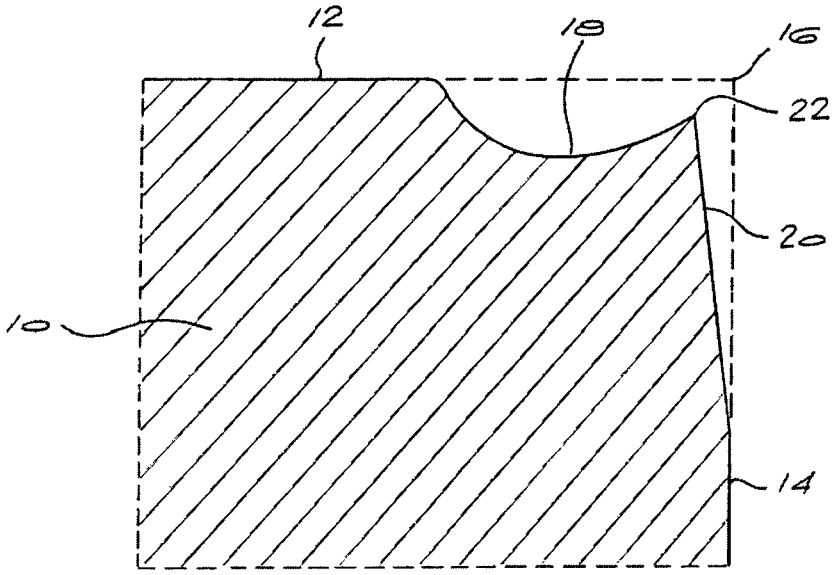
12
18
16
22
20
10
14

CBN COMPOSITE MATERIAL AND TOOL

This application is a 371 of PCT/IB2007/001046 filed on Apr. 23, 2007, published on Nov. 1, 2007 under publication number WO 2007/122490 A and claims priority benefits of South African Patent Application No. 2006/03211 filed Apr. 21, 2006, the disclosure of which is hereby incorporated by reference.

BACKGROUND OF THE INVENTION

This invention relates to a tool component and the use thereof, specifically to a tool component with enhanced wear resistance.

Boron nitride exists typically in three crystalline forms, namely cubic boron nitride (cBN), hexagonal boron nitride (hBN) and wurtzitic cubic boron nitride (wBN). Cubic boron nitride is a hard zinc blend form of boron nitride that has a similar structure to that of diamond. In the cBN structure, the bonds that form between the atoms are strong, mainly covalent tetrahedral bonds. Methods for preparing cBN are well known in the art. One such method is subjecting hBN to very high pressures and temperatures, in the presence of a specific catalytic additive material, which may include the alkali metals, alkaline earth metals, lead, tin and nitrides of these metals. When the temperature and pressure are decreased, cBN may be recovered.

cBN has wide commercial application in machining tools and the like. It may be used as an abrasive particle in grinding wheels, cutting tools and the like or bonded to a tool body to form a tool insert using conventional electroplating techniques.

cBN may also be used in bonded form as a cBN compact, also known as PCBN. cBN compacts tend to have good abrasive wear, are thermally stable, have a high thermal conductivity, good impact resistance and have a low coefficient of friction when in contact with a ferrous workpiece.

Diamond is the only known material that is harder than cBN. However, as diamond tends to react with certain materials such as iron, it cannot be used when working with iron containing metals and therefore use of cBN in these instances is preferable.

cBN compacts comprise sintered polycrystalline masses of cBN particles. When the cBN content exceeds 80 percent by volume of the compact, there is a considerable amount of direct cBN-to-cBN contact and bonding. When the cBN content is lower, e.g. in the region of 40 to 60 percent by volume of the compact, then the extent of direct cBN-to-cBN contact and bonding is less.

cBN compacts will generally also contain a binder phase which may be a cBN catalyst or may contain such a catalyst. Examples of suitable binder phases are aluminum, alkali metals, cobalt, nickel, and tungsten.

When the cBN content of the compact is less than 75 percent by volume there is generally present another hard phase, a third phase, which may be ceramic in nature. Examples of suitable ceramic hard phases are nitrides, borides and carbonitrides of a Group IVA or VB transition metal, aluminum oxide, and carbides such as tungsten carbide and mixtures thereof.

cBN compacts may be bonded directly to a tool body in the formation of a tool insert or tool. However, for many applications it is preferable that the compact is bonded to a substrate/support material, forming a supported compact structure, and then the supported compact structure is bonded to a tool body. The substrate/support material is typically a cemented metal carbide that is bonded together with a binder such as cobalt, nickel, iron or a mixture or alloy thereof. The metal carbide particles may comprise tungsten, titanium or tantalum carbide particles or a mixture thereof.

A known method for manufacturing the polycrystalline cBN compacts and supported compact structures involves subjecting an unsintered mass of cBN particles to high temperature and high pressure conditions, i.e. conditions at which the cBN is crystallographically stable, for a suitable time period. A binder phase may be used to enhance the bonding of the particles. Typical conditions of high pressure and temperature (HPHT) which are used are pressures of the order of 2 GPa or higher and temperatures in the region of 1100° C. or higher. The time period for maintaining these conditions is typically about 3 to 120 minutes.

The sintered cBN compact, with or without substrate, is often cut into the desired size and/or shape of the particular cutting or drilling tool to be used and then mounted onto a tool body utilising brazing techniques.

The cBN abrasive compacts, although performing acceptably, require continuing improvement in their properties to meet the need for better tool lifetimes and lower costs, and research and development are ongoing to provide such improvements in the marketplace.

cBN abrasive compacts are used in high-speed machining of hard ferrous materials such as die steels, alloy steels and hard-facing materials. The main advantage of high-speed hard turning is the elimination of expensive and time consuming grinding operation to finish the part. cBN abrasive compacts are the most suitable cutting tools for high-speed, hard-turning operations.

In high speed machining of hardened steels increased hardness of the work piece results in higher than usual cutting forces, stresses and temperatures at the cutting zone. In particular wear behaviour of a cBN cutting tool is very sensitive to temperatures developed at the chip-tool and workpiece tool interfaces. Elevated temperatures at the chip-tool interface causes accelerated wear mainly by chemical wear leading to a deep crater formation on the rake face of the tool. This results in formation of a sharpened cutting edge which is prone to chipping or fracture. In most cases the deep crater breaks the cutting edge with continuous wear, leading to a catastrophic failure of the cutting tool by edge chipping.

This is illustrated by the attached FIG. 1. Referring to FIG. 1, a tool component comprises a layer 10 of polycrystalline cBN material which has a rake (working) surface 12 and a flank surface 14. The cutting edge of the tool component, prior to use, is the edge 16. During use, a deep crater 18 forms and the flank surface 14 wears to form surface 20. Sharpened cutting edge 22 results.

In industry there is a drive towards ever increasing cutting speeds to improve throughput and productivity and hence severe crater wear formation is one of the biggest factors affecting the overall performance of cBN abrasive compact cutting tool and machining economics. Therefore, it is expected that any reduction in crater wear will not only result in longer tool life but also it will give the tool opportunity to be used at a higher cutting speed.

EP 102843 describes the use of a thin, wear-resistant refractory layer bonded to a PCBN tool insert where the cBN content is in excess of 70 vol %. The refractory layer is preferably titanium nitride or carbide, or a mixture thereof, and is typically less than 20 microns thick. It is applied after the PCBN tool is sintered and processed using a method such as CVD. High cBN PCBN is used in applications like turning or milling, which require a high degree of abrasion resistance. These applications are carried out at lower speeds (i.e. the tool does not get as hot) and the cBN is not compromised by exposure to chemically aggressive systems at high temperatures. By contrast, low cBN tools are used in high tool speed applications where failure due to crater wear is a major problem. High cBN content PCBN does not perform sufficiently well in these high speed, chemically demanding applications, because of a lack of chemical resistance. Whilst high cBN content PCBN may experience some degree of crater wear in their standard applications, it is never the dominant failure mode, as is the case with the low cBN materials.

SUMMARY OF THE INVENTION

According to the present invention, there is provided a tool component comprising a first layer of polycrystalline cBN material which has a rake (working) surface and a flank surface and a secondary layer across the rake surface or at least partially across the rake surface and comprising a refractory material and optionally a binder phase and optionally cBN, wherein the secondary layer has a higher resistance to crater formation than the first layer of cBN material.

The secondary layer preferably extends across the rake surface up to or close to a cutting edge on that surface. Secondary layer thickness is typically in the range of 30 μm to 300 μm and may be adjusted in such a way that the secondary layer predominantly forms the rake face of the cutting tool extending close to the cutting edge whereas the first layer forms the flank face of the tool component.

The secondary layer may be formed of at least two different layers with different compositions. The thickness of each such layer in the secondary layer is typically in the range of 30 μm to 300 μm.

The first layer and secondary layer may be metallurgically bonded to each other during high pressure and high temperature (HPHT) sintering or they may be metallurgically bonded or formed during a subsequent typically lower pressure sintering process such as HIPing, gas pressure phase sintering, microwave sintering, spark plasma sintering or laser sintering or a combination of these processes. Typical conditions of high pressure and temperature (HPHT) which are used are temperatures in the region of 1100° C. or higher and pressures of the order of 2 GPa or higher. The time period for maintaining these conditions is typically about 3 to 120 minutes. The cBN composite layer may be bonded to a substrate material such as cemented tungsten carbide or a cermet type of material.

The first layer of polycrystalline cBN material comprises less than 70 vol % cBN, preferably 35 to 65 vol % cBN, and most preferably 40 to 60 vol % cBN. The secondary layer may contain cBN which, when present, will typically be at least 10 volume percentage less than that of the first layer.

The first layer of polycrystalline cBN material typically has a thickness range from about 300 μm to 2000 μm, most preferably from about 500 μm to 1000 μm.

The secondary layer will typically contain ceramic (refractory) materials that have lower affinity towards iron than cBN. It is most preferable that the secondary layer contains at least one refractory phase selected from carbides, borides, nitrides, carbonitrides, oxides and/or silicides of metals in Group 4, 5, 6 or aluminum or silicon, and mixtures and/or solid solutions thereof.

In addition, the secondary layer will typically contain a binder matrix or phase containing elements selected from the transition metals (such as iron, cobalt and nickel), yttrium, titanium, aluminum and silicon.

This binder phase will typically comprise less than 20 volume percent of the secondary layer.

In the tool component of the invention, the secondary layer performs the function of increasing the crater resistance of the rake face. Although the secondary layer may, initially, also perform some cutting or abrading action in use, the primary cutting edge of the tool component is provided by the first polycrystalline cBN layer. Such cutting edge is the edge defined between the rake face and the flank surface or face of the first polycrystalline cBN layer.

The tool component of the invention further has particular application in the machining, particularly the high speed machining, of hard ferrous materials such as die steels, alloy steels and other hard facing materials. Hard ferrous materials have a Rockwell C Hardness of greater than 45 and typically 55 to 65. Thus, the invention provides, according to another aspect, the use of a tool component as described above in the machining, particularly high speed machining, of hard ferrous materials.

DETAILED DESCRIPTION OF PREFERRED EMBODIMENTS

The present invention relates to a tool component having a layer of polycrystalline cBN material predominantly forming the flank face of the tool component and across the (rake) working face or at least partially across the (rake) working face of the tool component is a secondary layer comprising a refractory material and typically another binder phase which can be selected from elements of, or compounds containing, silicon, nickel, aluminum, cobalt, titanium, yttrium and iron and mixtures or solid solutions thereof and optionally cBN. The secondary layer is preferably metallurgically bonded to the first layer and predominantly forms the rake face of the tool component.

The secondary layer forms a wear resistant top layer that has a higher resistance to crater formation than that of the first layer. The secondary layer may form a layer on the entire rake face of the tool component or only part thereof.

The secondary layer may be metallurgically bonded to the (rake) working face of the first layer.

The first layer of polycrystalline cBN material may be bonded to a substrate material such as cemented tungsten carbide or a cermet type of material.

The tool component of the invention may be produced by placing the secondary layer onto the (rake) working face of a layer of polycrystalline material and sintering at high temperature and high pressure conditions at which the cBN is crystallographically stable, for a suitable time period or it may be metallurgically bonded or formed by a subsequent sintering process, such as HIPing, gas pressure sintering, microwave sintering, spark plasma sintering or laser sintering.

Alternatively, the secondary layer may be formed through an in situ interaction of the first layer of cBN material with an appropriate canister or encapsulating material. During this in situ brazing or metallurgical bonding step, an additional metallic layer may be introduced between the first layer of cBN material and the secondary layer. The metallic layer may be selected from a group including copper, silver, zinc, cobalt and nickel, and alloys containing these metals.

In this form of the invention, the secondary layer is produced by interaction between the first layer of cBN material and an encapsulating or canister material used during sintering. The canister is typically a metal, such as titanium. The reaction between the cBN material and the canister material(s) will form a refractory layer that provides a higher resistance to crater formation than that of the first layer alone. The reaction layer forms by short range diffusion from the interface zone between the cBN material and the canister material(s), to a thickness of approximately 20 to 50 microns. After grinding to remove the majority of the unreacted canister material, the secondary layer will be present, providing a protective region as previously described. In the case of a canister metal such as titanium, this secondary layer will contain refractory titanium compounds such as titanium boride and titanium nitride. The canister material may additionally be selected to contain further alloying element or elements which may facilitate the formation of an appropriate binder phase for the refractory material. Examples of suitable elements are nickel and cobalt. These may persist in the metallic form within the final sintered product.

The thickness of the secondary layer is controlled in such a way that the secondary layer generally does not extend to the flank of the tool component and forms the rake face.

According to another aspect of the invention, a tool component comprises a layer of polycrystalline cBN material predominantly forming a flank face of the tool component and across a (rake) working face or at least partially across the (rake) working face of the tool component is a secondary layer comprising of at least two layers with different compositions of refractory materials and another phase which can be selected from elements of, and compounds containing, one or more of silicon, nickel, aluminum, cobalt, titanium and iron and mixtures or solid solutions thereof and optionally cBN. The secondary layer is formed by alternating at least two thinner layers with different compositions which are metallurgically bonded together during sintering. The secondary layer may be metallurgically bonded to the first layer and predominantly forms the rake face of the tool component. The first layer predominantly forms the flank face of the tool component.

The secondary layer forms a wear resistant top layer that has a higher resistance to crater formation than that of the first layer. Alternating layers within the secondary layer may be arranged in such a way that they provide an optimum metallurgical bond to the first layer by reducing thermal mismatch and also provide resistance to crater wear.

The secondary layer may form the rake face of the tool component. The first layer of polycrystalline cBN material may be bonded to a substrate material such as cemented tungsten carbide or a cermet type of material.

The tool component of the invention may be produced by placing various thin layers of different chemical composition on top of each other to form the secondary layer during sintering at high temperature and high pressure conditions at which the cBN is crystallographically stable, for a suitable time period or it may be metallurgically bonded or formed by a subsequent sintering process, such as HIPing, gas pressure sintering, microwave sintering, spark plasma sintering or laser sintering, or a combination of these processes. Alternatively, the secondary layer may be formed through an in situ brazing or metallurgical bonding reaction of the first layer of cBN material with an appropriate metal canister or layer. The thickness of the secondary layer, constituted by at least two different layers, is controlled in such a way that the secondary layer generally does not extend to the flank of the tool component and forms the rake face.

In use, crater wear forms largely in the secondary layer and flank wear forms in the first polycrystalline cBN layer. Cutting tool life is extended as a result of higher crater wear resistance of the secondary layer than the first layer during hardened steel machining, for example. Relatively higher crater wear resistance of the second layer in relation to the first layer delays the amount of crater wear formed and thereby extends the cutting tool life in high-speed, hard-turning applications.

The net result is that the cBN composite tool component has a longer cutting tool life or can operate at higher cutting speeds in finish machining of hardened steel than the equivalent cBN composite material that does not contain a secondary layer.

The tool component of the invention is typically used in high speed finish cutting of hard ferrous materials such as die steels, alloy steels and hard-facing materials.

The invention will now be described in more detail with reference to the following non-limiting examples.

EXAMPLE 1

Material-1A

A sub-stochiometric titanium carbonitride powder, $Ti(C_{0.7}N_{0.3})_{0.8}$ of average particle size of 1.4 micron was mixed with Al powder, average particle size of 5 micron, using a tubular mixer. The mass ratio between $Ti(C_{0.7}N_{0.3})_{0.8}$ and Al was 90:10. The powder mixture was pressed into a titanium cup to form a green compact and heated to 1025° C. under vacuum for 30 minutes and then crushed and pulverized. The powder mixture was then attrition milled for 4 hours and then 1.4 micron average particle size of cBN was added and attrition milled in hexane for an hour. The cBN was added in an amount such that the total volume percentage of calculated cBN in the mixture was about 60 percent. The slurry was dried under vacuum and formed into a green compact, which was supported by a tungsten carbide hard metal. After encapsulation, the unit was sintered at 55 kbar (5.5 GPa) and at a temperature around 1300° C.

Material-1B

A sub-stochiometric titanium carbonitride powder, $Ti(C_{0.7}N_{0.3})_{0.8}$ of average particle size of 1.4 micron was mixed with Al powder, average particle size of 5 micron, using a tubular mixer. The mass ratio between $Ti(C_{0.7}N_{0.3})_{0.8}$ and Al was 90:10. The powder mixture was pressed into a titanium cup to form a green compact and heated to 1025° C. under vacuum for 30 minutes and then crushed and pulverized. The powder mixture was then attrition milled for 4 hours and then 1.4 micron average particle size of cBN was added and attrition milled in hexane for an hour. The cBN was added in an amount such that the total volume percentage of calculated cBN in the mixture was about 60 percent. The slurry was dried under vacuum and formed into a green compact.

A powder mixture containing about 89 vol % $TiC_{0.8}$, and equal volume percentage of Al and Ni, was milled and mixed in an attritor mill and dried. A binder, PMMA (poly methyl methacylate), a plastisizer, DBP (dibutyl phthalate) of equal volume percentages were added into a container together with 50 vol % of total volume of the solvent material, containing 70 vol % methyl ethyl ketone and 30 vol % ethanol. The mixture was stirred at high speeds and then a powder mixture, containing $TiC_{0.8}$, Al and Ni, was added gradually into the liquid mixture to achieve a consistent viscosity that is suitable for tape casting. The mixed slurry was poured into a Dr. Blade set up and a thin layer (about 100 micron in thickness) of ceramic tape was cast and dried. After drying, layers of ceramic tape were placed on top of the already formed green compact. After encapsulation, the unit was sintered at 55 kbar (5.5 GPa) and at a temperature around 1300° C.

Material-1C

A sub-stochiometric titanium carbonitride powder, $Ti(C_{0.7}N_{0.3})_{0.8}$ of average particle size of 1.4 micron was mixed with Al powder, average particle size of 5 micron, using a tubular mixer. The mass ratio between $Ti(C_{0.7}N_{0.3})_{0.8}$ and Al was 90:10. The powder mixture was pressed into a titanium cup to form a green compact and heated to 1025° C. under vacuum for 30 minutes and then crushed and pulverized. The powder mixture was then attrition milled for 4 hours and then 1.4 micron average particle size of cBN was added and attrition milled in hexane for an hour. The cBN was added in an amount such that the total volume percentage of calculated cBN in the mixture was about 60 percent. The slurry was dried under vacuum and formed into a green compact.

A powder mixture containing about 63.5 vol % $TiC_{0.8}$, 30 vol % cBN, 2.6 vol % Al and 3.9 vol % of Ni was milled and mixed in an attritor mill and dried. A binder, PMMA (poly methyl methacylate), a plastisizer, DBP (dibutyl phthalate) of equal volume percentages were added into a container together with 50 vol % of total volume of the solvent material, containing 70 vol % methyl ethyl ketone and 30 vol % ethanol. The mixture was stirred at high speeds and then the powder mixture, containing $TiC_{0.8}$, cBN, Al and Ni, was added gradually into the liquid mixture to achieve a consistent viscosity that is suitable for tape casting. The mixed slurry was poured into a Dr. Blade set up and a thin layer (about 100 micron in thickness) of ceramic tape was cast and dried. After drying, layers of ceramic tape were placed on top of the already formed green compact. After encapsulation, the unit was sintered at 55 kbar (5.5 GPa) and at a temperature around 1300° C.

Material-1D

A sub-stochiometric titanium carbonitride powder, $Ti(C_{0.7}N_{0.3})_{0.8}$ of average particle size of 1.4 micron was mixed with Al powder, average particle size of 5 micron, using a tubular mixer. The mass ratio between $Ti(C_{0.7}N_{0.3})_{0.8}$ and Al was 90:10. The powder mixture was pressed into a titanium cup to form a green compact and heated to 1025° C. under vacuum for 30 minutes and then crushed and pulverized. The powder mixture was then attrition milled for 4 hours and then 1.4 micron average particle size of cBN was added and attrition milled in hexane for an hour. The cBN was added in an amount such that the total volume percentage of calculated cBN in the mixture was about 60 percent. The slurry was dried under vacuum and formed into a green compact.

A powder mixture containing about 46.9 vol % $TiN_{0.8}$, 46 vol % cBN, 3.1 vol % Ni and 4 vol % Al was milled and mixed in an attritor mill and dried. A binder, PMMA (poly methyl methacylate), a plastisizer, DBP (dibutyl phthalate) of equal volume percentages were added into a container together with 50 vol % of total volume of the solvent material, containing 70 vol % methyl ethyl ketone and 30 vol % ethanol. The mixture was stirred at high speeds and then a powder mixture, containing $TiNO_8$, cBN, Al and Ni, was added gradually into the liquid mixture to achieve a consistent viscosity that is suitable for tape casting. The mixed slurry was poured into a Dr. Blade set up and a thin layer (about 100 micron in thickness) of ceramic tape was cast and dried. After drying, layers of ceramic tape were placed on top of the already formed green compact. After encapsulation, the unit was sintered at 55 kbar (5.5 GPa) and at a temperature around 1300° C.

Material-1E

A sub-stochiometric titanium carbonitride powder, $Ti(C_{0.7}N_{0.3})_{0.8}$ of average particle size of 1.4 micron was mixed with Al powder, average particle size of 5 micron, using a tubular mixer. The mass ratio between $Ti(C_{0.7}N_{0.3})_{0.8}$ and Al was 90:10. The powder mixture was pressed into a titanium cup to form a green compact and heated to 1025° C. under vacuum for 30 minutes and then crushed and pulverized. The powder mixture was then attrition milled for 4 hours and then 1.4 micron average particle size of cBN was added and attrition milled in hexane for an hour. The cBN was added in an amount such that the total volume percentage of calculated cBN in the mixture was about 60 percent. The slurry was dried under vacuum and formed into a green compact.

A powder mixture containing about 90.7 vol % $Ti(C_{0.7}N_{0.3})_{0.8}$, 4.6 vol % Ni and 4.7 vol % Al was milled and mixed in an attritor mill and dried. A binder, PMMA (poly methyl methacylate), a plastisizer, DBP (dibutyl phthalate) of equal volume percentages were added into a container together with 50 vol % of total volume of the solvent material, containing 70 vol % methyl ethyl ketone and 30 vol % ethanol. The mixture was stirred at high speeds and then a powder mixture, containing $Ti(C_{0.7}N_{0.3})_{0.8}$, Ni and Al, was added gradually into the liquid mixture to achieve a consistent viscosity that is suitable for tape casting. The mixed slurry was poured into a Dr. Blade set up and a thin layer (about 100 micron in thickness) of ceramic tape was cast and dried. After drying, layers of ceramic tape were placed on top of the already formed green compact. After encapsulation, the unit was sintered at 55 kbar (5.5 GPa) and at a temperature around 1300° C.

Material-1F

A sub-stochiometric titanium carbonitride powder, $Ti(C_{0.7}N_{0.3})_{0.8}$ of average particle size of 1.4 micron was mixed with Al powder, average particle size of 5 micron, using a tubular mixer. The mass ratio between $Ti(C_{0.7}N_{0.3})_{0.8}$ and Al was 90:10. The powder mixture was pressed into a titanium cup to form a green compact and heated to 1025° C. under vacuum for 30 minutes and then crushed and pulverized. The powder mixture was then attrition milled for 4 hours and then 1.4 micron average particle size of cBN was added and attrition milled in hexane for an hour. The cBN was added in an amount such that the total volume percentage of calculated cBN in the mixture was about 60 percent. The slurry was dried under vacuum and formed into a green compact.

A powder mixture containing about 31.5 vol % $TiN_{0.8}$, 61.7 vol % $ZrO_2$, 1.4 vol % $Al_2O_3$ and 5.5 vol % $Y_2O_3$ was milled and mixed in an attritor mill and dried. A binder, PMMA (poly methyl methacylate), a plastisizer, DBP (dibutyl phthalate) of equal volume percentages were added into a container together with 50 vol % of total volume of the solvent material, containing 70 vol % methyl ethyl ketone and 30 vol % ethanol. The mixture was stirred at high speeds and then a powder mixture, containing $TiN_{0.8}$, $ZrO_2$, $Al_2O_3$ and $Y_2O_3$, was added gradually into the liquid mixture to achieve a consistent viscosity that is suitable for tape casting. The mixed slurry was poured into a Dr. Blade set up and a thin layer (about 100 micron in thickness) of ceramic tape was cast and dried. After drying, layers of ceramic tape were placed on top of the already formed green compact. After encapsulation, the unit was sintered at 55 kbar (5.5 GPa) and at a temperature around 1300° C.

The sintered materials, Material-1A to Material-1F, were processed using conventional grinding, lapping techniques, and EDM (Electron Discharge Machining) cutting. Cutting tool inserts from Material-1A to Material-1F were prepared according to the ISO standard insert geometry of SNMN090308 S0220. The cutting tools from Material-1B to Material-1F contained a second layer ceramic material of about 80 μm in thickness, and a first layer of cBN material of about 0.8 mm thickness supported by a tungsten carbide hard metal. In Materials-1B to -1F the second layer was bonded to the rake face of the first layer. There was no second layer ceramic material present on the rake face of Material-1A, and the rake face consisted exclusively of a layer of cBN material.

A machining test was carried out on the tool components prepared as described above. The workpiece, SAE4340 steel, was continuously machined using cutting speed of 250 m/min with the depth of cut of 0.2 mm and the feed rate of 0.1 mm/rev.

The cutting test was continued until the cutting edge failed by edge chipping and total cutting distance was measured as an indication of cutting tool performance. All of the tools failed as a result of deep crater formation leading to cutting edge chipping and none of the tested tools failed as a result of excessive flank wear. Therefore, it is expected that materials with higher resistance to cratering according to the invention will have a longer tool life or higher performance. The results are summarized in Table 1. The tool life measurements are normally from averages of 3 or more measurements.

TABLE 1

Total cutting tool life, expressed as sliding distance in metres of all the listed materials in Example 1.

| Materials | Total Sliding distance (m) |
|---|---|
| Material-1A | 2954 |
| Material-1B | 5018 |
| Material-1C | 5006 |
| Material-1D | 3958 |
| Material-1E | 6420 |
| Material-1F | 3716 |

It is clear that tool life is surprisingly improved by the presence of a secondary ceramic layer in reducing overall crater wear. The tool life in the case of Material-1E is more than doubled and around 25% improvement for Material-1F in relation to the performance of Material-1A, a prior art material.

EXAMPLE 2

Material-2A

A sub-stochiometric titanium carbonitride powder, $Ti(C_{0.7}N_{0.3})_{0.8}$ of average particle size of 1.4 micron was mixed with Al powder, average particle size of 5 micron, using a tubular mixer. The mass ratio between $Ti(C_{0.7}N_{0.3})_{0.8}$ and Al was 90:10. The powder mixture was pressed into a titanium cup to form a green compact and heated to 1025° C. under vacuum for 30 minutes and then crushed and pulverized. The powder mixture was then attrition milled for 4 hours and then 2 micron average particle size of cBN was added and attrition milled in hexane for an hour. The cBN was added in an amount such that the total volume percentage of calculated cBN in the mixture was about 60 percent. The slurry was dried under vacuum and formed into a green compact, which was supported by a tungsten carbide hard metal. After encapsulation, the unit was sintered at 55 kbar (5.5 GPa) and at a temperature around 1300° C.

Material-2B

A sub-stochiometric titanium carbonitride powder, $Ti(C_{0.7}N_{0.3})_{0.8}$ of average particle size of 1.4 micron was mixed with Al powder, average particle size of 5 micron, using a tubular mixer. The mass ratio between $Ti(C_{0.7}N_{0.3})_{0.8}$ and Al was 90:10. The powder mixture was pressed into a titanium cup to form a green compact and heated to 1025° C. under vacuum for 30 minutes and then crushed and pulverized. The powder mixture was then attrition milled for 4 hours and then 2 micron average particle size of cBN was added and attrition milled in hexane for an hour. The cBN was added in an amount such that the total volume percentage of calculated cBN in the mixture was about 60 percent. The slurry was dried under vacuum and formed into a green compact.

A powder mixture containing about 45 vol % $TiN_{0.8}$, 50 vol % cBN, 2.5 vol % Al and 2.5 vol % of Ni was milled and mixed in an attritor mill and dried. A binder, PMMA (poly methyl methacylate), a plastisizer, DBP (dibutyl phthalate) of equal volume percentages were added into a container together with 50 vol % of total volume of the solvent material, containing 70 vol % methyl ethyl ketone and 30 vol % ethanol. The mixture was stirred at high speeds and then the powder mixture, containing $TiN_{0.8}$, cBN, Al and Ni, was added gradually into the liquid mixture to achieve a consistent viscosity that is suitable for tape casting. The mixed slurry was poured into a Dr. Blade set up and a thin layer (about 100 micron in thickness) of ceramic tape was cast and dried. After drying, layers of ceramic tape were placed on top of the already formed green compact. After encapsulation, the unit was sintered at 55 kbar (5.5 GPa) and at a temperature around 1300° C.

The sintered materials, Material-2A and Material-2B, were processed using conventional grinding, lapping techniques, and EDM (Electron Discharge Machining) cutting. Cutting tool inserts from Material-2A and Material-2B were prepared according to the ISO standard insert geometry of SNMN090308 S0220. The cutting tools from Material-2B contained a second layer ceramic material of about 80 μm in thickness and a first layer of cBN material of about 0.8 mm thickness supported by a tungsten carbide hard metal. In Material-2B the second layer was bonded to the rake face of the first layer. There was no second layer ceramic material present on the rake face of Material-2A, and the rake face consisted exclusively of a layer of cBN material.

A machining test was carried out on the tool components prepared as described above. The workpiece, SAE4340 steel, was continuously machined using cutting speed of 250 m/min with the depth of cut of 0.2 mm and the feed rate of 0.1 mm/rev.

The cutting test was continued until the cutting edge failed by edge chipping and total cutting distance was measured as an indication of cutting tool performance. All of the tools failed as a result of deep crater formation leading to cutting edge chipping and none of the tested tools failed as a result of excessive flank wear. Therefore, it is expected that materials with higher resistance to cratering according to the invention will have a longer tool life or higher performance. The results are summarized in Table 2. The tool life measurements are normally from averages of 3 or more measurements.

TABLE 2

Total cutting tool life, expressed as sliding distance in metres of all the listed materials in Example 2.

| Materials | Sliding distance (m) |
|---|---|
| Material-2A | 2513 |
| Material-2B | 2943 |

The tool life is significantly improved by the presence of a secondary ceramic layer in reducing overall crater wear. The tool life in the case of Material-2B is significantly more than the performance of Material-2A, a prior art material.

The invention claimed is:

1. A tool component comprising a first layer of polycrystalline cBN material which has a rake (working) surface and a flank surface and comprising less than 70 vol % cBN; and a secondary layer at least partially across the rake surface and comprising a refractory material wherein the secondary layer has a higher resistance to crater formation than the first layer of cBN material, wherein the secondary layer contains cBN and is present in an amount of at least 10 volume percent less than that of the first layer, and wherein the secondary layer contains cBN.

2. A tool component according to claim 1 wherein the secondary layer has a lower affinity towards iron than cBN.

3. A tool component according to claim 1 wherein the secondary layer contains a refractory material selected from a carbide, boride, nitride, carbonitride, oxide, or silicide of a metal selected from Group 4, 5 or 6 or from aluminium or silicon, or a mixture and/or solid solution thereof.

4. A tool component according to claim 1 wherein the secondary layer also contains a binder phase.

5. A tool component according to claim 4 wherein the hinder phase is selected from the elements of, or compounds containing, silicon, nickel., aluminium, cobalt, titan iron, yttrium and iron.

6. A tool component according to claim 4 wherein the binder phase is present in an amount of less than 20 volume percentage of the secondary layer.

7. A tool component according to claim 1 wherein the secondary layer extends across the rake surface up to a cutting edge on that surface.

8. A tool component according to claim 1 wherein the secondary layer thickness is in the range of 30 μm to 300 μm.

9. A tool component according to claim 1 wherein the secondary layer is formed of at least two different layers with different compositions.

10. A tool component according to claim 9 wherein the thickness of each layer in the secondary layer is in the range of 30 μm to 300 μm.

11. A tool component according claim 1 wherein the first layer is bonded to a substrate material.

12. A tool component according to claim 11 wherein the substrate is made of cemented carbide or a cermet type of material.

13. A tool component according to claim 1 wherein the first layer of polycrystalline cBN material comprises between 35 and 65 vol % cBN.

14. A tool component according to claim 13 wherein the first layer of polycrystalline cBN material comprises between 40 and 60 vol % cBN.

15. A tool component according to claim 1 wherein the first layer of polycrystalline cBN material has a thickness range from about 300 μm to 2000 μm.

16. A tool component according to claim 15 wherein the first layer of polycrystalline cBN material has a thickness range from about 500 μm to 1000 μm.

17. A cutting tool comprising at least one tool component according to claim 1.

18. A tool component comprising:

a first layer of polycrystalline cBN material which has a rake (working) surface and a flank surface and comprising less than 70 vol % cBN; and a secondary layer at least partially across the rake surface, the secondary layer comprising a refractory material and a binder phase that contains an element selected from the group consisting of transition metals, yttrium, titanium, aluminum and silicon, wherein the secondary layer has a higher resistance to crater formation than the first layer of cBN material, wherein the secondary layer is formed of at least two different layers with different compositions and the thickness of each layer in the secondary layer is in the range of 30 μm to 300 μm.

19. A tool component according to claim 18 wherein the secondary layer has a lower affinity towards iron than cBN.

20. A tool component according to claim 18 wherein the secondary layer contains a refractory material selected from a carbide, boride, nitride, carbonitride, oxide, or suicide of a metal selected from Group 4, 5 or 6 or from aluminium or silicon, or a mixture and/or solid solution thereof.

21. A tool component according to claim 18 wherein the binder phase is present in an amount of less than 20 volume percentage of the secondary layer.

22. A tool component according to claim 18 wherein the secondary layer extends across the rake surface up to a cutting edge on that surface.

23. A tool component according to claim 18 wherein the secondary layer thickness is in the range of 30 μm to 300 μm.

24. A tool component according claim 18 wherein the first layer is bonded to a substrate material.

25. A tool component according to claim 24 wherein the substrate is made of cemented carbide or a cermet type of material.

26. A tool component according to claim 18 wherein the first layer of polycrystalline cBN material comprises between 35 and 65 vol % cBN.

27. A tool component according to claim 26 wherein the first layer of polycrystalline cBN material comprises between 40 and 60 vol % cBN.

28. A tool component according to claim 18 wherein the first layer of polycrystalline cBN material has a thickness range from about 500 μm to 1000 μm.

* * * * *

UNITED STATES PATENT AND TRADEMARK OFFICE

CERTIFICATE OF CORRECTION

PATENT NO. : 8,414,229 B2
APPLICATION NO. : 12/295762
DATED : April 9, 2013
INVENTOR(S) : Nedret Can et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 441 days.

Signed and Sealed this
Thirteenth Day of August, 2013

Teresa Stanek Rea
*Acting Director of the United States Patent and Trademark Office*